United States Patent [19]

Obrecht et al.

[11] Patent Number: 5,054,305

[45] Date of Patent: Oct. 8, 1991

[54] MULTIPLE FUNCTION HYDRAULIC APPARATUS

[75] Inventors: Robert E. Obrecht, Bloomfield Hills; Edward J. Waltonen, Southfield, both of Mich.

[73] Assignee: REO Hydraulic Pierce & Form Inc., Detroit, Mich.

[21] Appl. No.: 464,321

[22] Filed: Jan. 12, 1990

[51] Int. Cl.[5] ..... B21D 28/24

[52] U.S. Cl. ..... 72/333; 72/407; 72/453.01; 83/615; 83/639.1

[58] Field of Search ..... 72/334, 327, 407, 453.01, 72/453.02, 333; 83/639, 615, 519, 191-193, 188

[56] References Cited

U.S. PATENT DOCUMENTS

| | | | |
|---|---|---|---|
| 300,174 | 6/1884 | Webster | 72/407 |
| 1,875,448 | 9/1932 | Hanna | 72/407 |
| 3,008,032 | 11/1961 | Wolfbauer | 219/89 |
| 3,270,604 | 9/1966 | Waltonen | 83/140 |
| 3,396,260 | 8/1968 | Waltonen | 219/89 |
| 4,073,176 | 2/1978 | Paul | 72/328 |
| 4,098,161 | 7/1978 | Bloch | 83/519 |
| 4,716,803 | 1/1988 | Waltonen | 83/529 |
| 4,760,633 | 8/1988 | Dacey, Jr. | 29/432 |
| 4,763,550 | 8/1988 | Waltonen | 83/191 |

FOREIGN PATENT DOCUMENTS

| | | | |
|---|---|---|---|
| 678935 | 7/1939 | Fed. Rep. of Germany | 72/447 |
| 286201 | 11/1988 | Japan | 72/407 |
| 619271 | 8/1978 | U.S.S.R. | 72/407 |
| 846050 | 7/1981 | U.S.S.R. | 72/447 |
| 948525 | 8/1982 | U.S.S.R. | 72/447 |

*Primary Examiner*—Daniel C. Crane

*Attorney, Agent, or Firm*—Krass & Young

[57] ABSTRACT

An apparatus for performing mechanical operations such as piercing, punching and forming on a workpiece wherein the apparatus includes a carrier, a ram mounted for reciprocal movement on the carrier, a first fabricating tool mounted on the ram, a piston assembly mounted on the ram for reciprocal movement on the ram, a second fabricating tool mounted on the piston assembly, and a third fabricating tool mounted on the carrier. The first and third fabricating tools coact to perform a first work operation on a workpiece in response to relative movement between the ram and the carrier whereafter the second fabricating tool mounted on the piston assembly is utilized to perform a second work operation on the workpiece in response to relative movement between the piston assembly and the ram. The various movements between the ram, carrier, and piston assembly are accomplished by selective introduction of pressurized hydraulic fluid into various pressure chambers respectively defined by the ram, carrier, and piston assembly.

31 Claims, 7 Drawing Sheets

FIG - 7
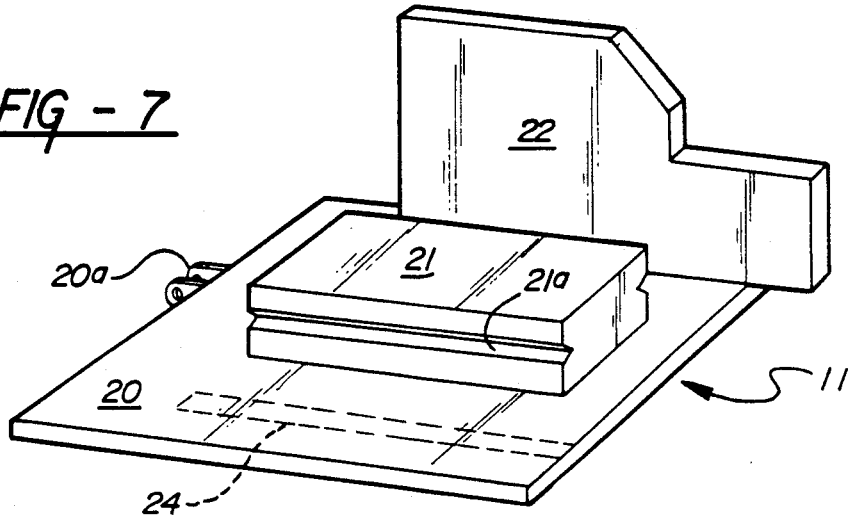
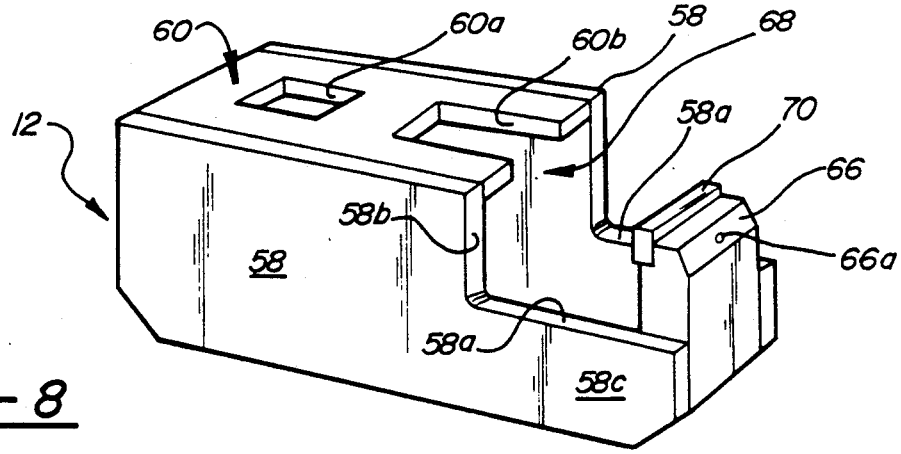
FIG - 8
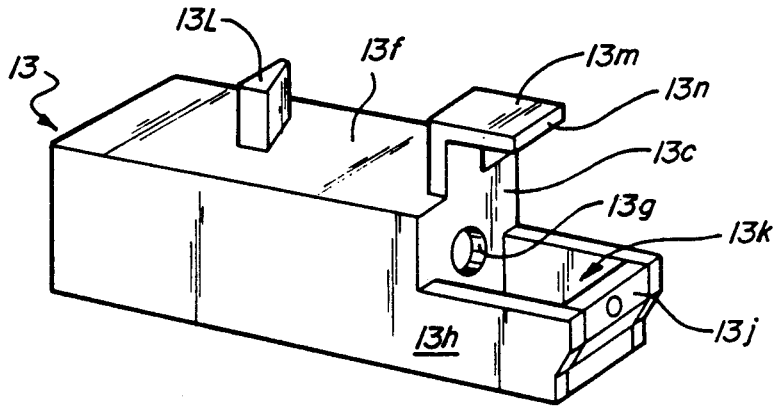
FIG - 9
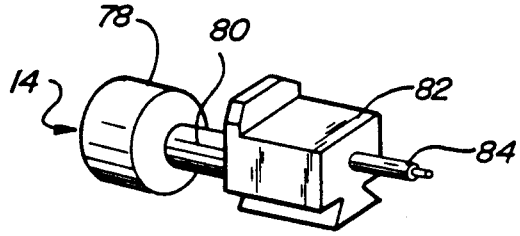
FIG - 10

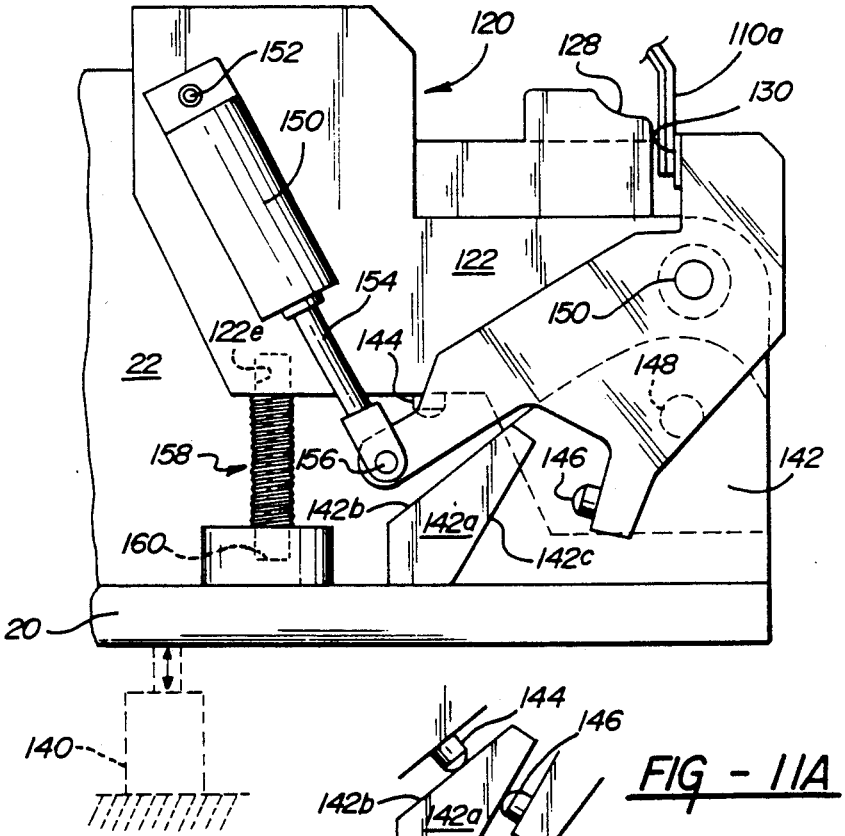
FIG - 11
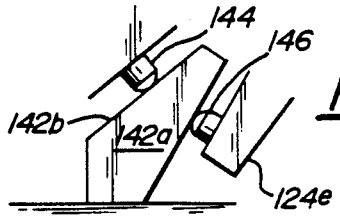
FIG - 11A
FIG - 16
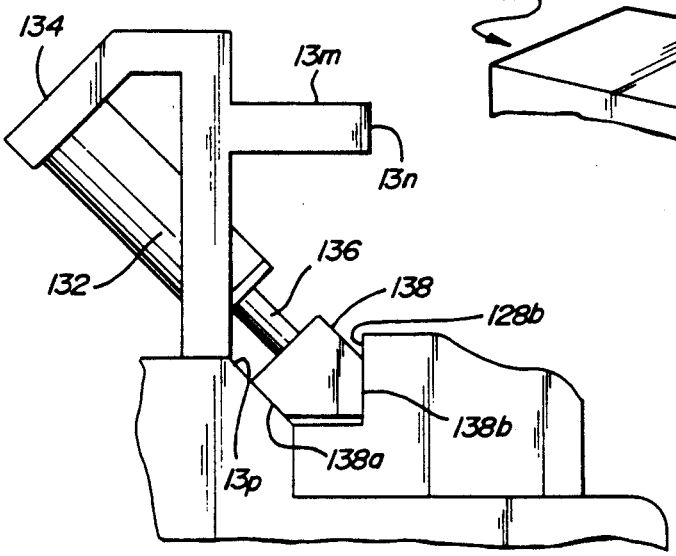
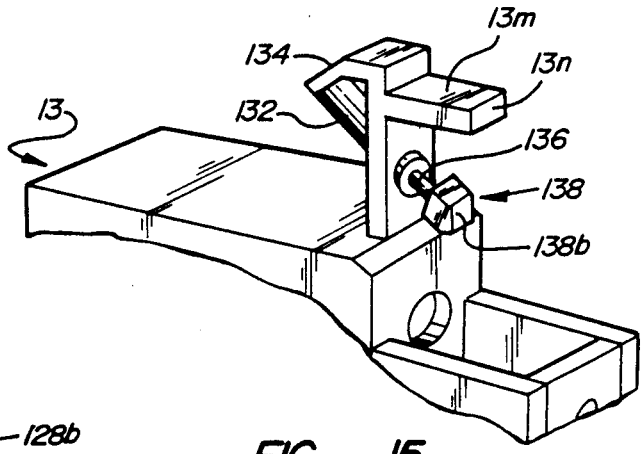
FIG - 15

FIG - 12
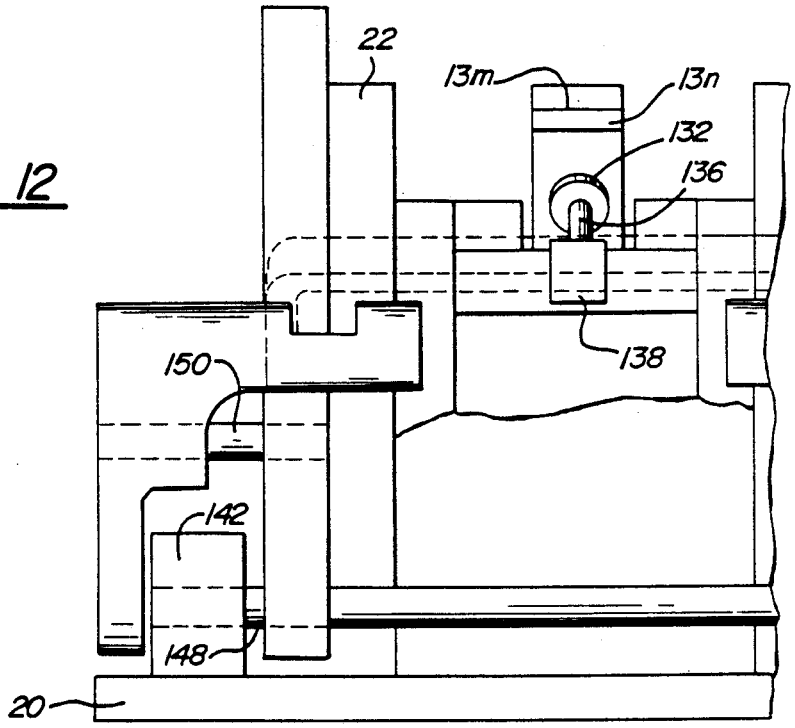
FIG - 13
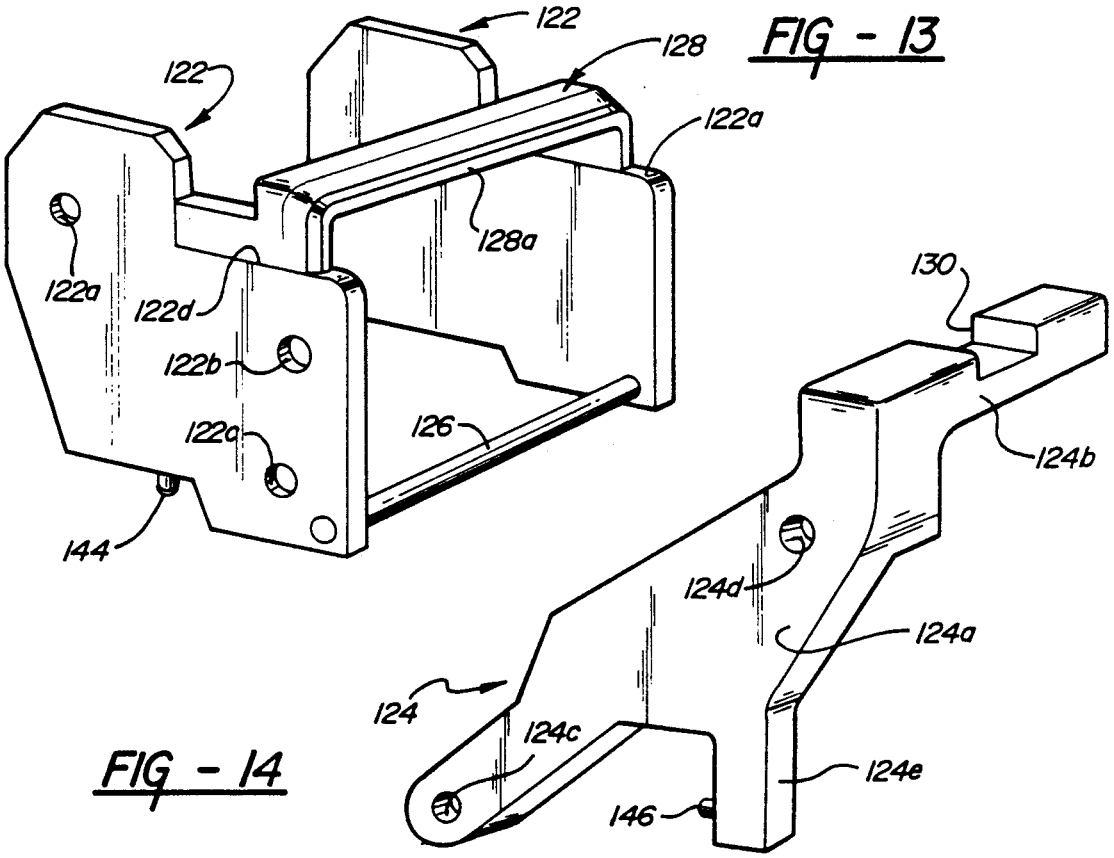
FIG - 14

MULTIPLE FUNCTION HYDRAULIC APPARATUS

BACKGROUND OF THE INVENTION

This invention relates to apparatus for performing mechanical operations such as piercing, punching and forming on a workpiece and more particularly to an improved apparatus of this type capable of performing a plurality of mechanical operations on a workpiece.

Mechanical operations such as piercing, punching, and shape forming are common to many industrial fabrication processes. Typically each operation is performed by a separate apparatus. Whereas the use of a separate apparatus to perform each operation is satisfactory in the sense that a separate apparatus may be designed and dedicated to a specific function so as to efficiently carry out that particular function, the use of a separate apparatus to perform each function is time consuming and requires extensive capital investment. Whereas many forms of apparatus have been provided for carrying out more than one operation on a workpiece, these prior art multiple function apparatuses have been generally clumsy and expensive and have generally optimized the performance of one work operation at the expense of the other operation or operations.

SUMMARY OF THE INVENTION

This invention is directed to the provision of an apparatus capable of efficiently carrying out a plurality of work operations on a workpiece.

More specifically, this invention is directed to the provision of a multiple function apparatus wherein at least certain of the functions may be carried out in a force equalizing mode so as to avoid damage to the workpiece during the performance of the work operation.

The apparatus according to the invention includes a carrier; a ram mounted for reciprocal movement on the carrier; ram power means operative to move the ram relative to the carrier; a first fabricating tool mounted on the ram; a piston assembly mounted on the ram for reciprocal movement on the ram; piston assembly power means operative to move the piston assembly relative to the ram; and a second fabricating tool mounted on the piston assembly. This arrangement allows the ram and carrier to undergo relative movement to perform a first work operation on a workpiece and further allows the piston to undergo movement relative to the ram to perform a second work operation on the workpiece.

According to a further feature of the invention, the apparatus further includes a third fabricating tool mounted on the carrier. This arrangement allows the first and third fabricating tools to coact to form a first work operation on the workpiece in response to relative movement as between the ram and the carrier and thereafter allow the second fabricating tool to perform a second work operation on the workpiece in response to relative movement between the piston assembly and the ram.

According to a further feature of the invention, the carrier defines a blind bore opening at the front end of the carrier; the ram is mounted for reciprocal movement in the blind bore; the ram includes central bore means; and the piston assembly includes a piston mounted for reciprocal movement in the ram central bore means and a connecting member extending through a forward bore wall of the ram for connection to the second fabricating tool. This arrangement provides an efficient and compact packaging as between the carrier, the ram, and the piston assembly so as to enable a single relatively compact machine to perform a plurality of work operations on a workpiece.

According to a further feature of the invention, the ram power means includes a core member extending forwardly from the rear wall of the carrier into the blind bore of the carrier and through a rear wall of the ram into the central bore means of the ram and including means dividing the ram central bore means into a first, forward pressure zone and a second, rearward pressure zone, in combination with means for delivering pressure fluid selectively to the pressure zones. This arrangement allows the carrier and ram to be selectively moved relative to each other in selected directions in response to respective delivery of pressurized fluid to the forward and rearward pressure zones defined within the ram central bore means.

According to a further feature of the invention, the piston is slidably mounted in the ram central bore means forwardly of the core member with its forward face defining a third pressure zone in the ram central bore means between the front face of the piston and the front wall of the ram, and the piston assembly power means includes means for selectively delivering pressure fluid to the third pressure zone. This arrangement allows the third pressure zone to be selectively pressurized and depressurized to enable the piston assembly to either move as a unit with the ram or to move relative to the ram to perform a separate work operation on the workpiece.

According to a further feature of the invention, the first fabricating tool comprises a forming anvil provided at the forward end of the ram and the second fabricating tool comprises a punch connected to the connector member of the piston assembly and slidably received at its forward end in a bore in the forming anvil. This arrangement allows the forming anvil at the forward end of the ram to be utilized to deform a sheet metal workpiece, whereafter the third pressure zone in the central ram bore may be depressurized to allow the punch to be moved forwardly relative to the ram to form a piercing operation on the sheet metal workpiece.

According to a further feature of the invention, the ram forming anvil is positioned in forwardly spaced relation to the front bore wall of the ram; the ram defines a guideway between the front bore wall and the forming anvil, and the piston assembly further includes a guide block slidably mounted in the guideway, secured at its rear end to the connector member of the piston assembly, and carrying the punch at its forward end. This arrangement provides a positive guiding arrangement for the forward stroking movement of the punch.

According to a further feature of the invention, the carrier defines a carrier forming anvil forwardly of the ram forming anvil for coaction with the ram forming anvil, and the apparatus further includes a base and means mounting the carrier for reciprocal movement on the base so that the ram may move relative to the carrier and the carrier may move relative to the base in response to introduction of pressure fluid into the first forward pressure zone.

According to a further feature of the invention, the means mounting the carrier on the base includes self-equalizing balancing means between the carrier and the base providing more resistance to reciprocal movement of the carrier on the base than to the ram in the carrier so that the initial movement as between the base, carrier and ram upon introduction of pressurized fluid into the first pressure zone involves movement of the ram relative to the carrier, whereby the ram forming anvil may be moved forwardly into a position relative to the front face of a workpiece to be formed, whereafter the carrier forming anvil may be moved rearwardly into position relative to the rear face of the workpiece.

According to a further feature of the invention, the apparatus further includes a locator member carried by the ram and engagable with a known reference surface as the ram moves forwardly to position the ram forming anvil at a predetermined position forwardly of the front face of the workpiece, whereafter the carrier forming anvil may move rearwardly and deform the workpiece against the ram forming anvil whereafter pressure in the third pressure zone may be relieved to allow the punch to be moved forwardly through the deformed portion of the workpiece to perform the piercing operation.

According to a further feature of one embodiment of the invention, the apparatus further includes a frame; the base is mounted for reciprocal movement on the frame; and the apparatus further includes means for selectively locking the ram to the frame and the base to the frame. This arrangement allows the ram and the base to be selectively immobilized by selectively locking them to the fixed ground provided by the frame.

According to a further feature of the invention, the apparatus further includes clamping means carried on the frame and movable into positions proximate the front and rear faces of the workpiece in the vicinity of the forming anvils to delineate the portion of the workpiece to be deformed.

In one embodiment of the invention, the clamping means includes first fixed clamping means movable into position proximate the front face of the workpiece and second pivotal clamping means movable pivotally into position proximate the rear face of the workpiece.

In a second embodiment of the invention, the clamping means comprises a pincer mechanism carried by the frame and movable into position on opposite faces of the workpiece in an equalizing manner. This arrangement minimizes deformation of the workpiece in the clamped area.

According to a further feature of the invention, the means for delivering pressurized fluid to the various pressure zones of the apparatus includes valving means operative to selectively:

1) deliver pressure fluid to the first and third pressure zones while depressurizing the second zone, whereby to move the ram forwardly relative to the carrier and move the first forming tool forwardly;

2) deliver pressurized fluid to the first zone while depressurizing the second and third zones, whereby to move the piston forwardly relative to the ram and move the second forming tool forwardly;

3) deliver pressurized fluid to the third zone while depressurizing the first and second zones, whereby to move the piston rearwardly relative to the ram and move the second forming tool rearwardly; and 4) deliver pressurized fluid to the second and third zones while depressing the first zone, whereby to move the ram rearwardly relative to the carrier and move the first forming tool rearwardly.

BRIEF DESCRIPTION OF THE DRAWING

FIG. 7 is a fragmentary perspective view of the frame assembly utilized in the apparatus of FIG. 1;

FIG. 8 is a perspective view of a carrier assembly utilized in the apparatus FIG. 1;

FIG. 9 is a perspective view of a ram assembly utilized in the apparatus of FIG. 1

FIG. 10 is a perspective view of a piston assembly utilized in the apparatus of FIG. 1;

FIG. 11 is a fragmentary side elevational view of a second embodiment of the invention apparatus;

FIG. 11A shows a portion of the FIG. 11 apparatus in a moved position;

FIG. 12 is a fragmentary front end view of the apparatus of FIG. 11;

FIG. 13 is a perspective view of part of a pincer mechanism utilized in the apparatus of FIG. 11;

FIG. 14 is a perspective view of another part of the pincer mechanism;

FIG. 15 is a fragmentary perspective view of the ram assembly utilized in the apparatus of FIG. 11;

FIG. 16 is a fragmentary somewhat schematic view illustrating a locking arrangement utilized in the apparatus of FIG. 11.

DETAILED DESCRIPTION OF THE PREFERRED EMBODIMENT

Figures 1, 2:
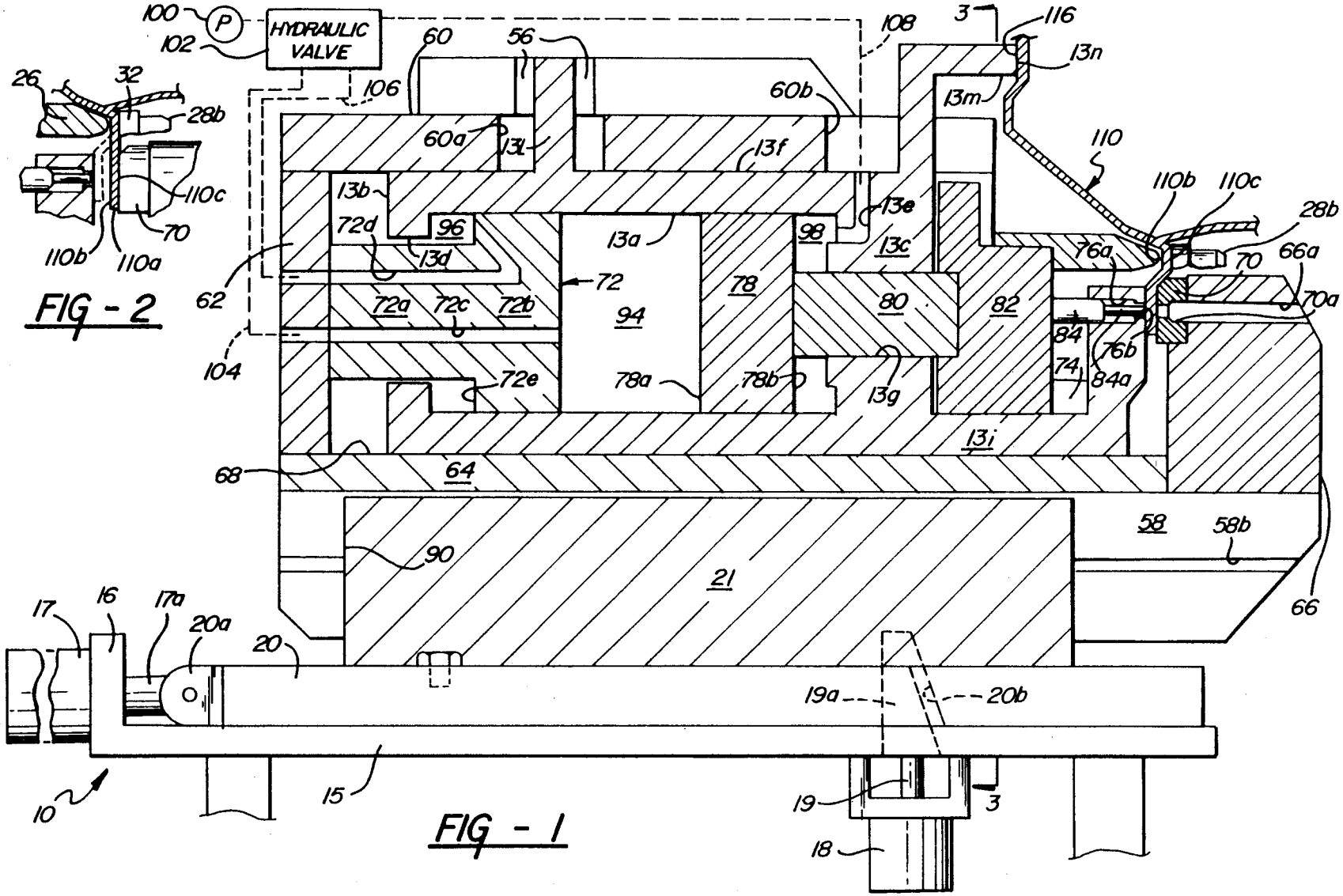
FIG. 1 is a longitudinal cross sectional view of a first embodiment of the invention apparatus.
FIG. 2 is a detailed view taken within the circle 2 of FIG. 1.

The invention apparatus of the FIGS. 1–10 embodiment, broadly considered, includes a foundation 10, a frame assembly 11, a carrier assembly 12, a ram assembly 13, and a piston assembly 14.

Foundation 10 includes a foundation plate 15, an end flange 16, a hydraulic ram 17 secured to the rear face of flange 16, and a further hydraulic ram 18 secured to the underface of foundation plate 15 and including a piston rod 19 carrying a wedge **19*a* eat its free upper end. Frame assembly 11 includes a bottom plate 20 including a pair of lugs 20*a* on the rear edge of the bottom plate coupled to the free forward end of the piston rod 17*a* of ram 27; a base member 21 including a bearing raceway 21*a* along each longitudinal vertical edge of the base member; spaced side plates 22 and 24 upstanding from bottom plate 20 in laterally spaced relation; a U-shaped clamp member 26 positioned between side plates 22 and 24 proximate the forward ends of the plates; a pair of clamps 28 each including a main body clamp arm portion 28*a* pivotally mounted intermediate its ends on a pivot pin 30 carried by aside plate 22, 24 and an auxiliary clamp arm portion 28*b* extending inboard from the upper end of a respective main body clamp portion 24*a*; a clamping pad 32 carried on the inboard end of each auxiliary clamp arm portion 28*b*; a pair of hydraulic rams 34 secured to the respective outboard faces of side plates 22 and 24 and each including a clevis 34*a* at is upper end pivotally mounted on a mounting block 36 secured to a respective outboard face of a side plate 22**, 24 and a piston rod 38 connected by a clevis 38*a* to the lower end of a respective main body arm portion 28*a*; and a pair of hydraulic rams 52 secured to the outboard face of side plate 22 and including piston rods 54 terminating in wedges 56. In a typical application, foundation 10 is rigidly secured in place and bottom plate 20 of frame assembly 11 is slidably mounted on foundation plate 15 with piston rod 17*a* coupled to lugs 20*a* so a to enable the frame assembly to be slidably moved along foundation plate 15 in response to actuation of ram 17.

Carrier assembly 12 includes a pair of side plates 58, a top plate 60, a rear plate 62, a bottom plate 64, and a front anvil 66 positioned between the forward ends of side plates 58. A window 60*a* is provided in top plate 60 proximate the rear end of the carrier assembly and a forwardly opening slot 60*b* is provided on top plate 60 proximate the forward end of the top plate. The forward ends of side plates 58 are cut away at 58*a* so as to define vertical side plate edges 58*b* and reduced height side plate portions 58*c* at the forward ends of the side plates, and the side plates 58, rear plate 62, top plate 60 and bottom plate 64 coact to define a blind bore 68 of rectangular cross section closed at its rear end by carrier rear plate 62 and opening proximate vertical side plate edges 58*b*. Anvil 66 carries a combined forming and piercing die 70 at its rearward upper face and includes a central slug discharge passage 66*a* aligned with and coacting with a central slug passage 70*a* in die 70.

Carrier assembly 12 further includes a core member 72 extending forwardly from the rear wall 62 of the carrier assembly of generally T configuration in longitudinal cross section. Core member 72 includes a stem portion 72*a* of circular transverse cross section and a piston portion 72*b* of circular transverse cross section at the free forward end of stem portion 72*a*. A first pressure passage 72*c* opens at its rear end in the rear face of carrier end plate 62 and extends longitudinally through core member 72 to open at its front end in the front face of core member piston portion 72*b*. A further fluid passage 72*d* opens at its rear end in the rear face of carrier end plate 62 and extends forwardly through core member 72 and then upwardly and rearwardly within the core member to open in the annular rear face 72*e* of piston portion 72*b* of the core member.

Ram assembly 13 is a monolithic structure, is generally of rectangular cross section, and is sized to fit slidably within the blind bore 68 of carrier assembly 12.

Ram assembly 13 includes a central bore 13*a* of circular cross section extending between a rear wall 13*b* of the ram and a front bore wall 13*c* of the ram. A central circular opening 13*d* is provided in rear wall 13*b* and a fluid passage 13*e* extends downwardly through the top wall 13*f* of the ram into front bore wall 13*c* and then rearwardly within front bore wall 13*c* to open in ram central bore 13*a*. A central opening 13*g* is provided in front bore wall 13*c*. A pair of spaced vertical side plates 13*h* and a bottom plate 13*i* are provided at the forward end of the ram assembly and a forming anvil 13*j* is positioned between the forward ends of side plates 13*h*. The ram front bore wall 13*c* coacts with the inboard faces of side plates 13*h*, the upper face of bottom plate 13*i*, and the rear face of anvil 13*j* to define a rectangular guideway 13*k* between the front bore wall 13*c* and anvil 13*j*. A Wedge plate 131 extends upwardly from the top wall 13*f* of the ram assembly proximate the rear end of the ram assembly and an L-shaped feeler 13*m* extends upwardly from the top wall 13*f* of the ram assembly proximate front bore wall 13*c* and then extends forwardly to terminate in a front feeler face 13*n*. A pair of wedge shaped guide members 74 are secured to the bottom wall 13*i* of the ram on opposite sides of slideway 13*k* and extend within the slideway from the front face of ram front bore wall 13*c* to the rear face of anvil 13*j*. Anvil 13*i* includes a punch bore 76 including an enlarged portion 76*a* opening in the rear face of the anvil and a reduced diameter punch bore 76*d* opening in the front face of the anvil.

Piston assembly 14 includes a piston 78, a connector member 80, a guide block 82 and a punch 84. Piston 78 has a transverse circular cross sectional configuration corresponding to the circular configuration of ram bore 13*a*, connector member 80 has a transverse circular cross sectional configuration corresponding to the circular configuration of opening 13*g* in ram front bore wall 13*c*; guide member 82 has a rectangular transverse cross-sectional configuration corresponding to the cross sectional configuration of ram guideway 13*k*; and punch 84 has a circular transverse cross sectional configuration sized to fit slidably within punch bore 76. Connector member 80 is secured at its rear end to piston 78 and at its forward end to guide block 82 and punch 84 extends forwardly from the front face of guide block 82. The invention apparatus further includes self-equalizing means providing more resistance to reciprocal movement of the carrier assembly on the base member 21 than to the ram assembly in the carrier assembly. The self-equalizing means may be of the general type disclosed in U.S. Pat. Nos. 4,716,803 or 4,763,550, both assigned to the assignee of the present invention.

Figure 3:
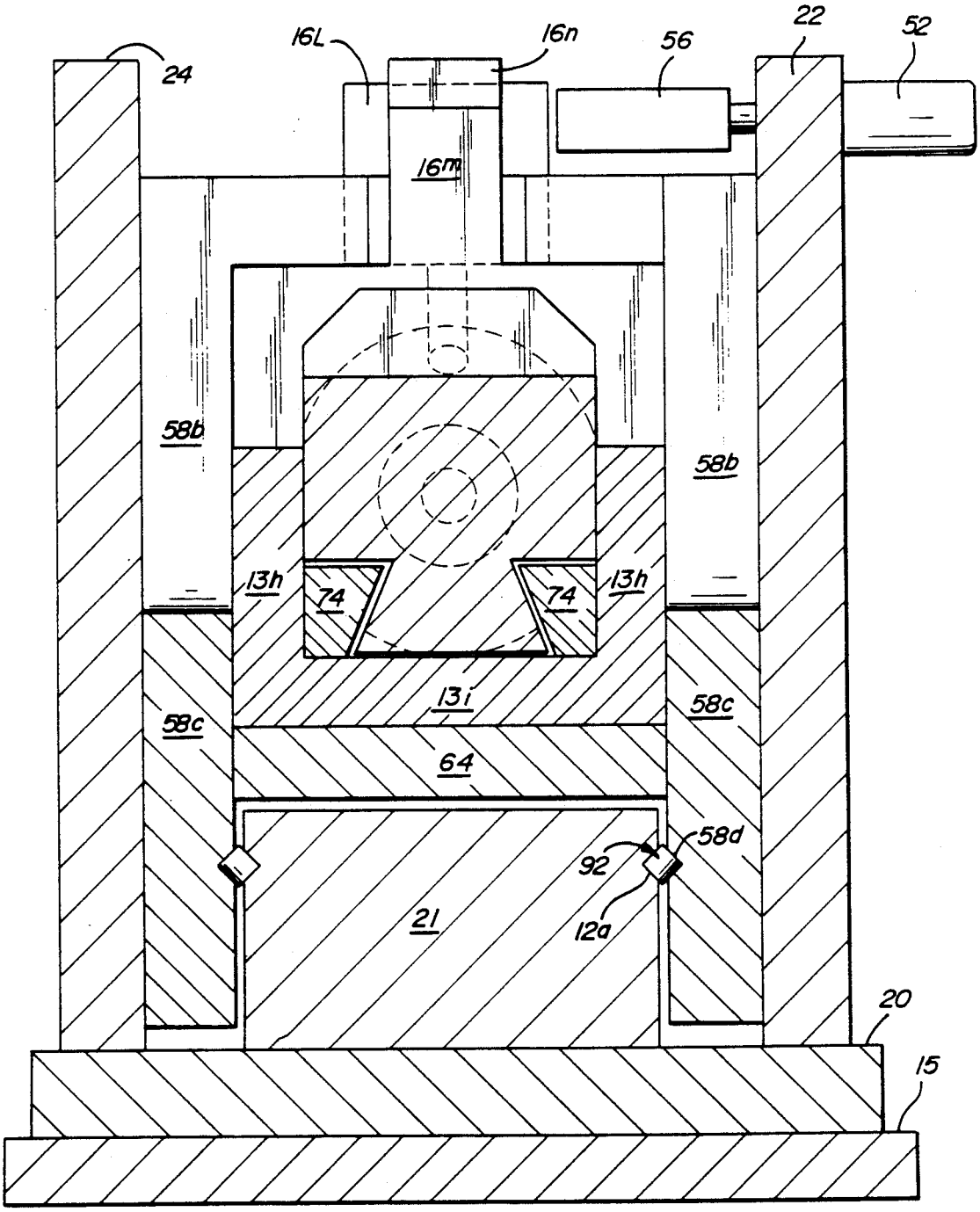
FIG. 3 is a cross sectional view taken on line 3—3 of FIG. 1.
Figure 4:
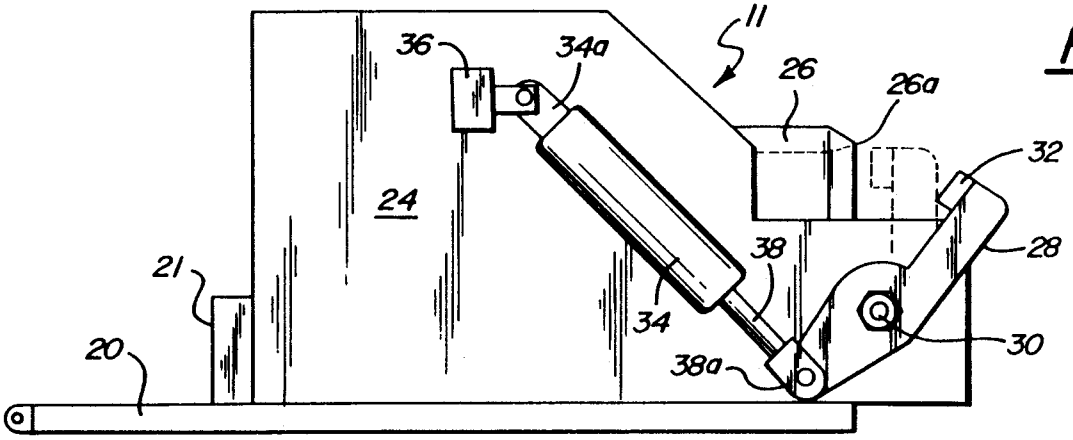
FIGS. 4, 5 and 6 are side elevational, plan, and end views of a frame assembly utilized in the apparatus of FIG. 1.
Figure 6:
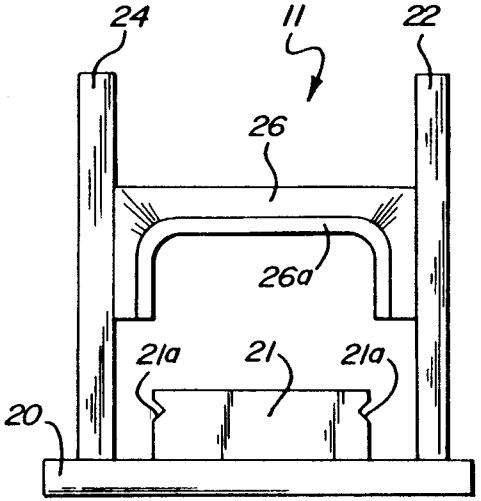
Figure 5:
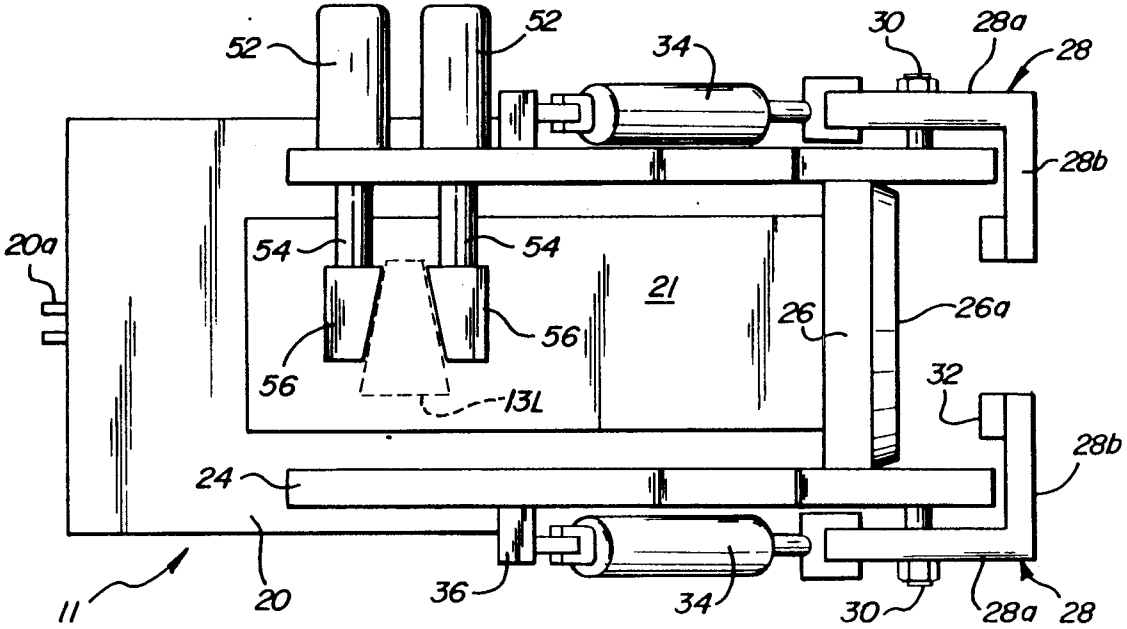

In the assembled relation of the invention apparatus, as seen in FIGS. 1 and 3, foundation assembly 10 is suitably anchored adjacent a work station at which a workpiece will be positioned so a to enable the invention apparatus to perform work operations on the workpiece; bottom plate 20 of frame assembly 11 is positioned on top of the foundation plate 15 of the foundation assembly with lugs 20*a* interconnected to the front end of the piston rod 17*a* of hydraulic ram 17 so that selective actuation of hydraulic ram 17 causes frame assembly 11 to slide in a reciprocating manner forwardly and rearwardly on foundation plate 15; carrier assembly 12 is positioned between side plates 22 and 24 with the outboard faces of carrier side plates 58 slidably guiding on the inboard faces of frame assembly side plates 22, 24, with base member 21 positioned between carrier side plates 58 beneath carrier bottom plate 64, and with the carrier assembly slidably mounted on base member 21 by linear roller bearings 92 rollably positioned in guideways 21*a* on the base member and in confronting guideways 58*d* on the inboard faces of carrier assembly side plates 58; ram assembly 13 is slidably mounted in the blind bore 68 of the carrier assembly with wedge member 131 projecting upwardly through window 60*a* in carrier top plate 60, feeler 13*m* projecting upwardly through carrier top plate slot 60*b*, the front face of ram anvil 13*j* positioned in rearwardly spaced relation to the rear face of carrier anvil 66, and carrier core member 72*a* extending forwardly into carrier blind bore 68 and through ram rear wall 13*b* to dispose core piston portion 72*b* within ram central bore 13*a* where it seals at its outer periphery with the inner periphery of bore 13*a* to divide bore 13*a* into a first pressure zone 94 forwardly of core piston portion 72*b* and a second, annular pressure zone 96 rearwardly of core piston portion 72*b*; and piston assembly 14 is mounted in ram assembly 13 with piston 78 slidably and sealingly mounted in ram central bore 13*a* forwardly of core piston portion 72*b* with its rear face 78*a* exposed to first pressure zone 94 and with its front annular face 78*b* spaced rearwardly from ram front bore wall 13*c* to define a third, annular pressure zone 98 between piston 78 and ram front bore wall 13*c*, connector member 80 extending forwardly from piston 78 and passing slidably and sealingly through opening 13*g* so as to project at its forward end into guideway 13*k*, guide block 82 secured at its rear end to the forward end of connector member 80 and slidably guiding in guideway 13*k*, and punch 84 projecting forwardly from guide block 82 and slidably received at its forward end in punch passage 76 of ram anvil member 13*j*.

The apparatus further includes a hydraulic fluid pump 100 and a hydraulic valve 102 connected to pressure zones 94, 96 and 98 respectively by conduits 104, 106 and 108 and operative in known manner to selectively deliver pressurized fluid from pump 100 to zones 94, 96 and 98 and to selectively depressurize the selective pressure zones. It will be understood that hydraulic lines, not shown, also connect valve assembly 102 with hydraulic rams 17, 18, 34 and 52 to selectively provide pressurized fluid to these rams and selectively depressurize these rams.

The invention apparatus is seen in FIGS. 1 and 2 positioned adjacent a work station on a motor vehicle assembly line at which a vehicle body-in-white 110 is positioned to enable the invention apparatus to perform work operations on the body-in-white.

Specifically, the invention apparatus is arranged to move the lower sill 110*a* of the body-in-white from an imprecise initial position as seen in FIG. 2 rearwardly to a precisely determined position as seen in FIG. 1 and thereafter pierce one or more holes in the precisely positioned sill so as to facilitate the attachment of an outer body panel to the body-in-white.

The body-in-white is moved into position relative to the invention apparatus by moving the body along the vehicle assembly line by suitable means to bring the sill 110 between the anvils 13*j* and 66 with the ram 13 in a retracted rearward position relative to the carrier assembly 12. Hydraulic cylinder 17 is now suitably actuated to move the frame assembly forwardly until the front edge 26*a* of fixed clamp 26 moves into engagement with the outer face 110*b* of the sill 110*a*, whereafter rams 34 are actuated to pivot clamps 28 about pin 30 and move the clamp pads 32 into engagement with the inner face 110*c* of the sill 110*a* so as to clamp the sill between the clamp 26 and 28, whereafter ram 18 is suitably actuated to move wedge 19*a* upwardly into coaction with a wedge pocket 20*b* opening in the lower face of frame assembly bottom plate 20 so as to lock the frame assembly to the foundation assembly.

Pressurized fluid is now delivered to pressure zones 94 and 98 while venting chamber 96. Because of the self-equalizing balance means between the carrier assembly and the base member providing more resistance to reciprocal movement of the carrier on the base member than to the ram in the carrier, the ram now moves to the right in the carrier until the leading edge 13*n* of the feeler 13*m* makes contact with a known precisely positioned reference surface 113 on body-in-white 110 so as to position the front face of anvil 13*j* in a precisely determined position, spaced from the outer face 110*b* of sill 110*a*, relative to known reference point 113, whereafter rams 52 are actuated to move wedges 56 into wedging coaction with the opposite wedge faces of wedge member 131 so as to lock the ram relative to the frame assembly whereafter, with continued pressurizing of pressure zones 94 and 98 with zone 96 depressurized, carrier assembly 12 moves rearwardly to the left as viewed in FIG. 1 to bring anvil 66 into position adjacent the inner face 110*c* of sill 110*a* to thereafter, with continued leftward or rearward movement of anvil 66, deform the portion of sill 110*a* delineated between the clamps 26 and 28 and move the sill to a precisely determined position against the front face of anvil 13*j*, whereafter pressure zone 98 is depressurized while maintaining pressure in zone 94 so as to cause piston assembly 18 to move forwardly, or to the right as viewed in FIG. 1, and move the front end 84*a* of punch 84 in a piercing manner through the deformed portion of sill 110*a* so as to provide an attachment hole in the sill with the pierced slug being ejected through slug passage 66*a*, whereafter pressure zone 98 is again pressurized while depressurizing zone 94 to withdraw the punch rearwardly, or to the left as seen in FIG. 1, to the disengaged position seen in FIG. 1, whereafter rams 52 are actuated in a sense to withdraw wedges 56 from engagement with wedge block 131 so as to unlock the ram from the frame assembly, whereafter pressure zone 96 is pressurized while depressurizing zone 94 to move the ram to the left and the carrier to the right in a self-equalizing manner so as to move the anvils 13*j* and 66 away from the respective outer and inner surfaces of the deformed and pierced sill, whereafter rams 34 are suitably actuated to withdraw pivotal clamps 28 from engagement with the inner face of the sill, whereafter ram 18 is suitably actuated in a sense to withdraw wedge 19*a* from wedge cavity 20*b* and unlock the frame assembly from the foundation assembly, whereafter ram 17 is suitably actuated to pull the frame assembly to the left as viewed in FIG. 1 to return the apparatus to its starting position preparatory to the arrival of another body-in-white.

The second embodiment of the invention apparatus, as seen in FIGS. 11–16, is generally similar to the apparatus of FIGS. 1–10 with the exception that the clamp member 26 carried by the frame assembly and the clamps 28 pivotally mounted to the frame assembly are replaced by a pincer mechanism 120 mounted on the frame assembly; the ram is locked to one part of the pincer mechanism following positioning of the clampingjaws of the pincer mechanism against the opposite faces of the sill of the body-in-white; and the apparatus is moved into position relative to the body-in-white by a substantially vertical upward movementof the apparatus, with the pincers in an open position, to dispose the opposed clamping jaws of the pincer mechanism on opposite sides of the sill.

Pincer mechanism 120 is self equalizing and includes a pair of pincer arms 122, best seen in FIG. 13, and a pair of pincer arms 124, best seen in FIG. 14. Each pincer arm 122 includes a ram mounting aperture 122*a*, a pivot aperture 122*b*, and a trunnion aperture 122*c*. The two arms 122 are joined at their low front ends by a tie bar 126 and a clamping die 128, generally similar to the clamping die 26 of the FIGS. 1–10 embodiment, extends between mounting surfaces 122*d* on each pincer arm 122 so as to define a U-shaped clamping die edge 128*a* extending upwardly from and between the spaced pincer arms 122.

Pincer arms 124 each include a main body portion 124*a* and an auxiliary portion 124*b* extending inboard from the upper end of main body portion 124*a* and carrying a clamping pad 130 at its inboard end for coaction with the clamping die 128. Main body portion 124a of each pincer arm 124 further defines a piston rod aperture 124c, and a pivot aperture 124d, and a stop arm portion 124e.

The ram assembly 13 of the FIGS. 11–16 embodiment is generally similar to the ram assembly of the FIGS. 1–10 embodiment with the exception that the assembly includes a pressure sensitive locking hydraulic cylinder 132 mounted at one end thereof on a bracket 134 extending rearwardly from feeler 13m and mounted at the other end thereof in the upstanding portion of the feeler 13m and including a piston rod 136 carrying a wedge block 138 at the free end thereof slidably guiding along its lower face 138a on a beveled guide surface 13p defined by the ram proximate the lower end of feeler 13m. Cylinder 132 is of the touch and lock type in which the cylinder hydraulically locks in response to a predetermined amount of pressure encountered by the wedge block 138. Hydraulic cylinder 132 may for example be of the type available from C. M. Smiley Company of Ferndale, Mich. as touch and lock cylinder Part No. TLH-B12C.

The frame assembly 11 of the FIG. 11–16 embodiment is generally similar to the frame assembly of the FIGS. 1–10 embodiment with the exception that the frame assembly is not mounted on a foundation member for reciprocal movement relative to the workpiece but rather is adapted to be lifted directly vertically into position relative to the sill of the motor vehicle as for example by a hydraulic ram 140, and with the further exception that the base plate 20 of the frame assembly mounts a pair of trunions 142 outboard of each side plate 22,24 with each trunion 142 including a stop pad portion 142a defining a first stop surface 142b for coaction with a pin stop 144 carried by the respective pincer arm 122 and a second stop surface 142c for coaction with a stop pin 146 carried by the stop arm portion 124d of a respective pincerarm 124.

In the assembled relation of the parts, each pincer arm 122 is pivoted to a respective trunnion 142 by a pin 148; each pincer arm 124 is pivoted to a respective pincer arm 122 by a pivot pin 150 respectively received in aperture 124d and in aperture 122b so as to pivotally join each pair of pincer arms 122,124 in a scissors manner; a hydraulic ram 150 is pivotally secured at its upper end by a pin 152 received in aperture 122a of the respective pincer arm 122 with the lower end of its piston rod 154 pivotally secured by a pivot pin 156 received in the pivot aperture 124c of a respective pincer arm 124; and a counter-balance spring 158 is received at its upper end in a blind socket 122e in a respective pincer arm 122 and is received at its lower end in a blind socket 160 suitably defined on the frame structure.

In the operation of the embodiment of FIGS. 11–16, the body-in-white is moved into position over the apparatus and the apparatus is moved vertically upwardly by ram 140 to move the apparatus into a working position relative to the sill of the body-in-white.

Specifically, with the pincer mechanism in a position such that stops 144 are abutting against surface 142b and stops 146 are abutting against surfaces 142c so that the pincer arms are opened to separate clamp die 128 and clamp pads 130, the apparatus is moved upwardly into a predetermined upper stop position in which the clamp die 128 and the clamp pads 130 are positioned in spaced relation on opposite sides of the sill 110a, whereafter cylinders 150 are actuated in a manner to extend the cylinders to allow stops 146 to move away from stop surfaces 142c and to bring pads 130 into engagement with the rear face of sill 110a, whereupon springs 158 act on arms 122 to pivot clamp die 128 into position against the front face of the sill as stop pins 144 move away from the stop surfaces 142b. As pins 146 and 144 move away from the respective stop surfaces defined by the pads 142a, the pincer mechanism assumes a floating posture so as to allow the pads 130 and the die clamp 128 to move in an equalizing manner and to seek out the sill 110a so as to ensure that the die clamp 128 and the pads 130 will firmly clamp the opposite faces of the sill within a range of relative positions of the sill as compared to the raised position of the invention apparatus.

As soon as the die clamp 128 and pads 130 have firmly clamped the opposite faces of the sill, the apparatus is suitably actuated in a manner to move the ram forwardly toward the body-in-white until the contact face 13n of the feeler 13m contacts the known reference point 116 whereupon a limit switch (not shown) operates to actuate the hydraulic cylinder 132 to move wedge 138 downwardly along beveled face 13p of the ram until the front edge 138b of the wedge contacts a stop or wedge face 128b defined along the rear edge of the clamp die 128 whereupon the cylinder 132, in known manner and in response to a predetermined sensed force exerted against the wedge 138, operates to hydraulically lock the cylinder 132 so as to lock the ram to die clamp 128.

The apparatus now functions in the manner described with respect to the FIGS. 1–10 embodiment to selectively pressurize and depressurize zones 94, 96 and 98 to move the carrier 12 rearwardly to the left (as viewed in FIG. 1) to bring anvil 66 into position adjacent the inner face 110c of the sill and to thereafter, with continued leftward or rearward movement of anvil 66, deform the portion of the sill 110 delineated between the die clamp 128 and the pads 130 and move the sill to a precisely determined position against the front face of anvil 13j, whereafter pressure zone on 98 is depressurized while maintaining pressure in zone 94 so as to cause piston assembly 18 to move forwardly or to the right (as viewed in FIG. 1) and move the front end 84a of punch 84 in a piercing manner through the deformed portion of sill 110a so as to provide an attachment hole in the sill with the pierced slug being ejected through a slug passage 66a, whereafter pressure zone 98 is again pressurized while depressurizing zone 94 to withdraw the punch rearwardly, or to the left (as seen in FIG. 1) to a disengaged position, whereafter cylinder 132 is retracted to unlock the ram from the die clamp, whereafter pressure zone 96 is pressurized while depressurizing zone 94 to move the ram to the left and the carrier to the right in a self-equalizing manner so as to move the anvils 13j and 66 away from the respective outer and inner surfaces of the deformed and pierced sill, whereafter rams 50 are actuated in a sense to move the pincer mechanism to an open position, whereafter ram 140 is actuated in a sense to lower the apparatus to return the apparatus to its starting position preparatory to the arrival of another body-in-white.

Figure 17:
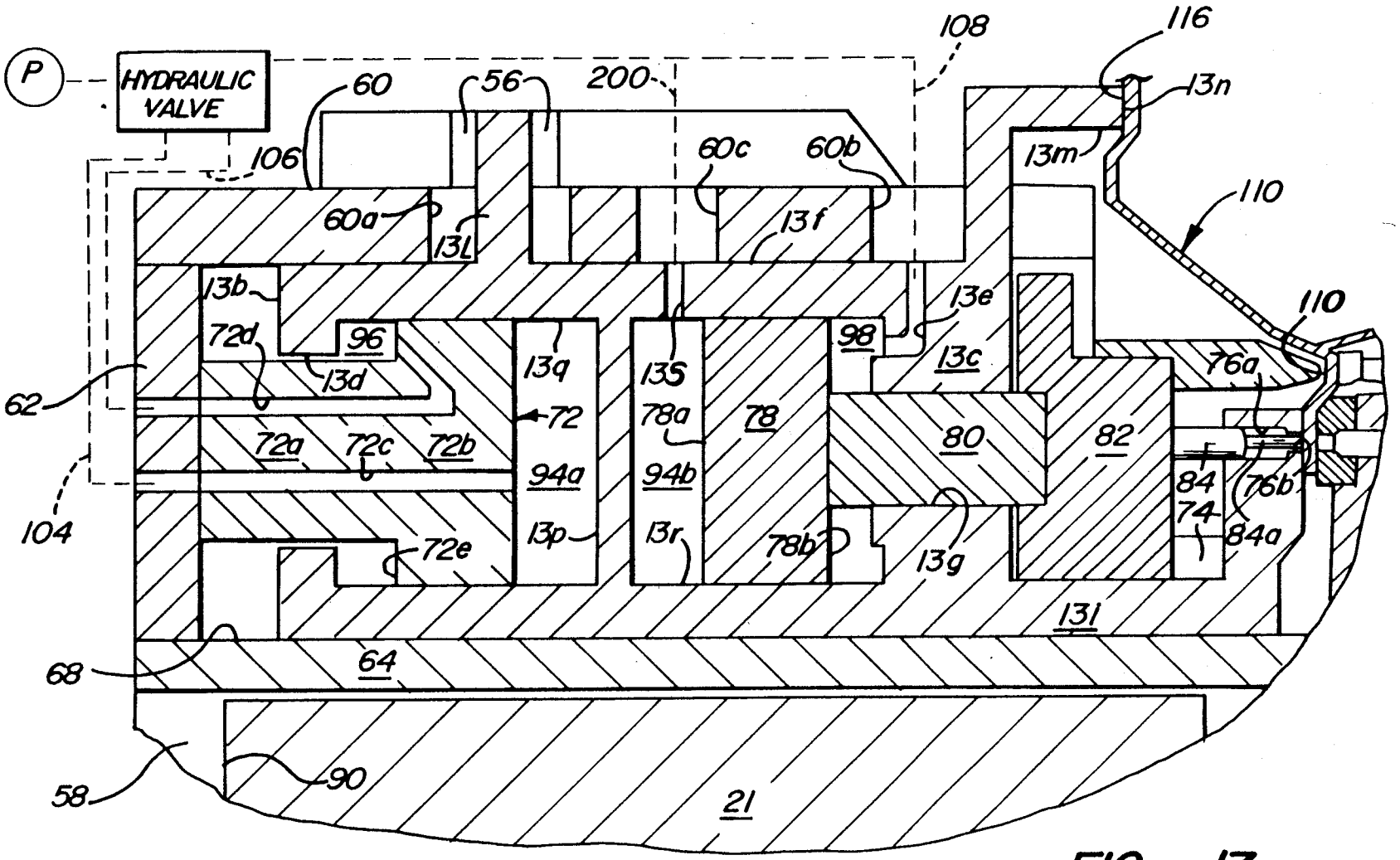
FIG. 17 is s fragmentary view of a third embodiment of the invention apparatus.

The third invention embodiment seen in FIG. 17 is generally similar to the embodiment of FIGS. 1–10 with the exception that a central partition 13m is provided on ram 13 so as to divide the central bore of the ram into a left bore portion 13q and a right bore portion 13r and divide pressure zone 94 into a left pressure zone 94a and a right pressure zone 94b. Pressurized fluid is selectively delivered to and removed from pressure zone 94b through a fluid passage 13s in ram 13 communicating with a conduit 200 passing through a window 60c in the top plate 60 of carrier assembly 12 and forming a part of the hydraulic circuitry for the apparatus.

The apparatus of FIG. 17 is moved into position relative to the body-in-white in the same manner as previously described with respect to the FIGS. 1–10 ebbodiment. Specifically, the body-in-white is moved into position relative to the apparatus by moving the body-in-white along the vehicle assembly line by suitable means to bring the sill 110 between the anvils 13j and 66 with the ram 13 in a retracted rearward position relative to the carrier assembly 12. Hydraulic cylinder 17 is now suitably actuated to move the frame assembly forwardly until the front edge 26a of fixed clamp 26 moves into engagement with the outer face 110b of the sill 110a, whereafter rams 34 are actuated to pivot clamps 28 about pin 30 and move the clamp pads 32 into engagement with the interface 110c of the sill 110a so as to clamp the sill between the clamps 26 and 28, whereafter ram 18 is suitably actuated to move wedge 19a upwardly into coaction with wedge pocket 19b in the lower face of the frame assembly bottom plate 20 so as to lock the frame assembly to the foundation assembly. At this time, cylinders 96 and 98 are pressurized while zones 94a and 94b are vented. Zone 96 is now vented and pressurized fluid is delivered to chamber 94a via conduit 104. Because of the self-equalizing balance means between the carrier assembly and the base member providing more resistance to reciprocal movement of the carrier on the base member than to the ram in the carrier, the ram now moves to the right in the carrier until the leading edge 13n of the feeler 13m makes contact with a known precisely positioned reference surface 113 on body-in-white 110 so as to position the front face of anvil 13j in a precisely determined position, spaced from the outer face 110b of sill 110a relative to known reference point 113, whereafter rams 52 are actuated to move wedges 56 into wedging coaction with the opposite wedge member 131 so as to lock the ram relative to the frame assembly whereafter, with continued pressurizing of pressure zones 94a and 98 with zones 96 and 94b vented, carrier assembly 12 moves rearwardly to the left to bring anvil 66 into position adjacent the inner face 110c of sill 110a to thereafter, with continued leftward or rearward movement of anvil 66, deform the portion of sill 110a delineated between the clamps 26 and 28 and move the sill to a precisely determined position against the front face of anvil 13j, whereafter pressure zone 98 is depressurized while delivering pressurized fluid to zone 94b through passage 13s so as to cause piston assembly 18 to move forwardly, or to the right, and move the front end 84a of punch 84 in a piercing manner through the deformed portion of sill 110a so as to provide an attachment hole in the sill with the pierced slug being ejected through slug passage 66a, whereafter pressure zone 98 is again pressurized while depressurizing zone 94b to withdraw the punch rearwardly, or to the left, to the disengaged position, whereafter rams 52 are actuated in a sense to withdraw wedges 56 from engagement with wedge block 131 so as to unlock the ram from the frame assembly, whereafter pressure zone 96 is pressurized while depressurizing zone 94a to move the ram to the left and the carrier to the right in a self-equalizing manner so as move the anvils 13j and 66 away from the respective outer and inner surfaces of the deformed and pierced sill, whereafter rams 34 are suitably actuated to withdraw pivotal clamps 28 from engagement with the interface of the sill, whereafter ram 18 is suitably actuated in a sense to withdraw wedge 19a from wedge cavity 20b and unlock the frame assembly from the foundation assembly, whereafter ram 17 is suitably actuated to pull the frame assembly to the left to return the apparatus to its starting position preparatory to the arrival of another body-in-white.

As compared to the FIGS. 1–10 embodiment, the embodiment of FIG. 17 simplifies the machining of the apparatus since only two short bores are required to be machined in the ram, one from each end face of the ram, rather than one long bore, and further allows a pressure to be delivered to the apparatus to actuate the punch that is precisely calibrated to effectively perform the punching operation rather than utilizing the higher pressure required to perform the self-equalizing movement of the apparatus. The apparatus of FIG. 17 also simplified the hydraulic valving required in association with the apparatus.

The invention apparatus will be seen to provide a compact, simple, and inexpensive apparatus for performing a plurality of work operations on a workpiece and, more specifically, for performing a plurality of work operations on a workpiece wherein one or more of the work operations is performed in a self-equalizing fashion so as to minimize damage to the workpiece.

Whereas preferred embodiments of the invention apparatus has been illustrated and described in detail it will be apparent that various changes may be made in the disclosed embodiments without departing from the scope or spirit of the invention.

We claim:

1. An apparatus for performing work operations on a workpiece comprising:

a frame;

a carrier mounted for reciprocal movement on said frame;

a ram mounted for reciprocal movement on said carrier;

pressure fluid means operative to move said ram relative to said carrier and said carrier relative to said frame;

a first fabricating tool mounted on said ram;

a piston assembly mounted on said ram for reciprocal movement on said ram;

piston assembly power means operative to move said piston assembly relative to said ram; and a second fabricating tool mounted on said piston assembly.

2. An apparatus for performing work operations on a workpiece, said apparatus comprising:

a carrier defining a blind bore closed at one end by a rear wall of said carrier and opening at the front end of said carrier;

a ram mounted for reciprocal movement in said bore and defining a first forming tool at its forward end;

central bore means in said ram defined between front and rear walls of said ram;

a core member extending forwardly from said rear wall of said carrier into said blind bore and through said rear wall of said ram into said central bore means and including means dividing said central bore means into a first, relatively forward pressure zone and a second, relatively, rearward pressure zone;

a piston slidably mounted in said central bore means forwardly of said core member with its front face spaced rearwardly from said front ram wall to define a third pressure zone between said piston and said front ram wall;

a second forming tool;

a connector extending through said ram front wall and connecting said piston and said second forming tool; and means for selectively delivering pressure fluid to said first, second and third pressure zones to selectively relatively move said carrier, said ram, and said piston.

3. An apparatus according to claim 2 wherein:

said apparatus further includes a third forming tool defined on said carrier forwardly of said first and second forming tools.

4. An apparatus according to claim 3 wherein:

said apparatus further includes a frame and means mounting said carrier for reciprocal movement on said frame so that said first tool may be moved into coaction with an outer face of a workpiece by forward movement of said ram relative to said carrier, said second tool may be moved into coaction with an outer face of the workpiece by forward movement of said piston relative to said ram, and said third tool may be moved into coaction with an inner face of the workpiece by rearward movement of said carrier on said frame.

5. An apparatus according to claim 4 wherein:

said carrier mounting means includes self-equalizing balance means between said carrier and said frame providing more resistance to reciprocal movement of said carrier on said frame than to said ram in said carrier so that the initial movement as between said frame, carrier, and ram upon introduction of pressurized fluid into said first pressure zone involves forward movement of said ram relative to said carrier, whereby said first tool may be moved forwardly into a position proximate said outer face of the workpiece, whereafter said carrier may move rearwardly on said frame to move said third forming tool rearwardly into a position proximate the inner face of the workpiece.

6. An apparatus according to claim 2 wherein:

the rear face of said piston is exposed to said first pressure zone; and said delivery means includes valving means operative to selectively deliver pressure fluid to said first and third zones while depressurizing said second zone, whereby to move said ram forwardly relative to said carrier and move said first forming tool forwardly, deliver pressure fluid to said first zone while depressurizing said second and third zones, whereby to move said piston forwardly relative to said ram and move said second forming tool forwardly, deliver pressure fluid to said third zone while depressurizing said first and second zones, whereby to move said piston rearwardly relative to said ram and move said second forming tool rearwardly, and deliver pressurized fluid to said second and third zones while depressurizing said first zone, whereby to move said ram rearwardly relative to said carrier and move said first forming tool rearwardly.

7. An apparatus according to claim 6 wherein:

said apparatus further includes a frame and means mounting said carrier for reciprocal movement on said frame; and said carrier mounting means includes self-equalizing balance means between said carrier and said frame providing more resistance to reciprocal movement of said carrier on said frame than to said ram in said carrier so that, in response to delivery of pressurized fluid to said first and third zones while depressurizing said second zone, said ram initially moves forwardly relative to said carrier to move said first forming tool forwardly to a predetermined position relative to an outer face of a workpiece, whereafter said carrier moves rearwardly on said frame to move said third forming tool rearwardly into a position proximate an inner face of the workpiece.

8. An apparatus for performing work operations on a workpiece, said apparatus comprising:

a frame;

a carrier mounted for reciprocal movement on said frame;

a ram mounted for reciprocal movement on said carrier;

ram power means operative to move said ram relative to said carrier;

a first fabricating tool mounted on said ram;

a piston assembly, including a piston, mounted on said ram for reciprocal movement on said ram;

fluid pressure power means operative to generate a fluid pressure differential on opposite sides of said piston and operative in response to generation of such pressure differential to move said piston assembly relative to said ram;

a second fabricating tool mounted on said piston assembly; and a third fabricating tool mounted on said carrier.

9. An apparatus for performing work operations on a workpiece, said apparatus comprising:

a frame;

a carrier mounted for reciprocal movement on said frame and defining a blind bore opening at the front end of the carrier;

a ram mounted for reciprocal movement in said blind bore and including a central bore;

ram power means operative to move said ram relative to said carrier;

a first fabricating tool mounted on said ram;

a second fabricating tool;

a piston assembly including a piston mounted on reciprocal movement in said central bore and a connecting member extending through a forward bore wall of said ram for connection to said second fabricating tool; and fluid pressure power means operative to generate a fluid pressure differential on opposite sides of said piston and operative in response to generation of such pressure differential to move said piston assembly relative to said ram.

10. An apparatus according to claim 9 wherein:

said ram power means includes a core member extending forwardly from the rear wall of said carrier into said blind bore and through a rear wall of said ram into said central ram bore and including means dividing said central ram bore into a first, forward pressure zone and a second, rearward pressure zone, and means for delivering pressure fluid selectively to said pressure zones.

11. An apparatus according to claim 10 wherein:

said piston is slidably mounted in said central ram bore forwardly of said core member with its rear face exposed to said first pressure zone and with its forward face defining a third pressure zone in said central ram bore between the front face of said piston and the front bore wall of said ram; and said piston assembly power means includes means for selectively delivering pressure fluid to said third pressure zone.

12. An apparatus according to claim 11 wherein:

said first fabricating tool comprises a forming anvil provided at the forward end of said ram; and said second fabricating tool comprises a punch connected to said connector member and slidably received at its forward end in a bore in said ram forming anvil.

13. Apparatus according to claim 12 wherein:

said ram forming anvil is positioned in forwardly spaced relation to said front bore wall of said ram;

said ram defines a guideway between said front bore wall and said forming anvil; and said piston assembly further includes a guide block slidably mounted in said guideway, secured at its rear end to said connector member, and carrying said punch at its front end.

14. An apparatus according to claim 13 wherein:

said carrier defines a carrier forming anvil forwardly of said ram forming anvil for coaction with said ram forming anvil.

15. An apparatus according to claim 14 wherein:

said apparatus further includes a frame and means mounting said carrier for reciprocal movement on said frame so that said ram may move relative to said carrier and said carrier may move relative to said frame in response to introduction of pressure fluid into said first pressure zone.

16. An apparatus according to claim 15 wherein:

said mounting means includes self-equalizing balance means between said carrier and said frame providing more resistance to reciprocal movement of said carrier on said frame than to said ram in said carrier so that the initial movement as between said frame, carrier, and ram upon introduction of pressurized fluid into said first pressure zone involves movement of said ram relative to said carrier, whereby said ram forming anvil may be moved forwardly into position relative to an outer face of a workpiece to be formed, whereafter said carrier forming anvil may be moved rearwardly into position relative to an inner face of the workpiece.

17. An apparatus according to claim 16 wherein:

said apparatus further includes a locator member carried by said ram and engagable with a known reference surface as said ram moves forwardly to position said ram forming anvil at a predetermined position forwardly of said outer face of the workpiece whereafter said carrier forming anvil may move rearwardly and deform said workpiece against said ram forming anvil, whereafter pressure in said third zone may be relieved to allow said punch to be moved forwardly through the deformed portion of said workpiece.

18. An apparatus according to claim 17 wherein:

said apparatus further includes a foundation;

said frame is mounted for reciprocal movement on said foundation; and said apparatus further includes means for selectively locking said ram to said frame and said frame to said foundation.

19. An apparatus according to claim 18 wherein:

said apparatus further includes clamping means carried by said frame and movable into positions proximate the outer and inner faces of the workpiece in the vicinity of said forming anvils to delineate the portion of the workpiece to be deformed.

20. An apparatus according to claim 19 wherein:

said clamping means includes first clamping means movable into position proximate said outer face of the workpiece and second, pivotal clamping means movable pivotally into position proximate said inner face of the workpiece.

21. An apparatus according to claim 20 wherein:

said first clamping means is fixed to said frame.

22. An apparatus according to claim 20 wherein:

said clamping means comprises a pincer mechanism pivotally mounted on said frame and including first and second arms respectively defining said first and second clamping means.

23. An apparatus according to claim 9 wherein:

said central bore includes a forward portion and a rearward portion separated by a central partition;

said piston is positioned in said forward ram bore portion; and said ram power means includes a core member extending forwardly from a rear wall of said carrier into said blind bore and through a rear wall of said ram into said rearward ram bore portion and including means dividing said rearward ram bore portion into a first forward pressure zone and a second rearward pressure zone and means for delivering pressure fluid selectively to said pressure zones.

24. An apparatus according to claim 23 wherein:

said piston is slidably mounted in said forward ram bore portion forwardly of said partition with its rear face exposed to a third pressure zone defined in said forward ram bore portion between the forward face of said partition and said rear face of said piston and with its forward face defining a fourth pressure zone in said forward ram bore portion between the front face of said piston and the front bore wall of said ram; and said piston assembly power means includes means for selectively delivering pressure fluid to said third and fourth pressure zones.

25. An apparatus for performing work operations on a workpiece, said apparatus comprising:

a frame;

a carrier mounted for reciprocal movement on said frame;

coacting relative movable first and second clamping means carried by said frame and movable into positions respectively proximate the outer end inner faces of the workpiece;

a ram mounted for reciprocal movement on said carrier;

ram power means operative to move said ram relative to said carrier;

a first fabricating tool mounted on said ram;

a piston assembly mounted on said ram for reciprocal movement on said ram;

fluid pressure power means operative to generate a fluid pressure differential on opposite sides of said piston assembly and operative in response to generation of such pressure differential to move said piston assembly relative to said ram; and a second fabricating tool mounted on said piston assembly.

26. An apparatus according to claim 25 wherein:

said clamping means includes first clamping means movable into position proximate said outer face of the workpiece and second, pivotal clamping means movable pivotally into position proximate said inner face of the workpiece.

27. An apparatus according to claim 26 wherein:

said first clamping means is fixed to said frame.

28. An apparatus to claim 26 wherein:

said clamping means comprise a pincer mechanism pivotally mounted on said frame and including first and second arms respectively defining said first and second clamping means.

29. An apparatus according to claim 29 wherein:

said apparatus further includes means for locking said ram to one of said arms of said pincer mechanism.

30. An apparatus according to claim 28 wherein:

said pincer mechanism further includes a power cylinder pivotally mounted at one end thereof to said first arm and pivotally mounted at the other end thereof to said second arm;

said first arm is pivotally mounted to said frame; and said second arm is pivotally mounted to said first arm.

31. An apparatus according to claim 30 wherein:

said apparatus further includes means for locking said first arm to said ram.

* * * * *